US006383045B1

(12) United States Patent
Eckardt

(10) Patent No.: US 6,383,045 B1
(45) Date of Patent: May 7, 2002

(54) MARKER BUOY

(76) Inventor: Ronald Eckardt, 217 Connetquot Rd., Bayport, NY (US) 11705

( * ) Notice: Subject to any disclaimer, the term of this patent is extended or adjusted under 35 U.S.C. 154(b) by 0 days.

(21) Appl. No.: 09/839,977

(22) Filed: Apr. 21, 2001

(51) Int. Cl.[7] ..... B60L 11/02
(52) U.S. Cl. ..... 441/6; 440/16; 440/26
(58) Field of Search ..... 441/6, 11–20, 441/23–26

(56) References Cited

U.S. PATENT DOCUMENTS 3,005,215 A * 10/1961 Colt et al. ..... 441/25
3,162,870 A * 12/1964 Laird ..... 441/16
4,344,110 A * 8/1982 Ruediger ..... 362/32

FOREIGN PATENT DOCUMENTS

GB 1433791 * 4/1976 ..... 441/26

* cited by examiner

*Primary Examiner*—Ed Swinehart
(74) *Attorney, Agent, or Firm*—Michael I Kroll

(57) ABSTRACT

A marker buoy is provided for use with a flexible line tied to a weighted sinker. The buoy includes a watertight, transparent dome assembly with an interior light source positioned therein. The dome assembly resides on a buoyant housing with a bottom aperture and line guide for receiving and guiding a flexible line for winding on a reel assembly positioned within the housing. The reel assembly utilizes a spiral coil spring that is wound as the line unwinds from the spool and acts to return excess line to the spool as the sinker attached to the line comes to rest on its intended submerged surface. In one embodiment a reduction gear is provided to increase the number of spool turns available before the spring winds completely.

25 Claims, 9 Drawing Sheets

MARKER BUOY

BACKGROUND OF THE INVENTION

1. Field of the Invention

The present invention relates generally to floating marker buoys.

2. Description of the Prior Art

There are other marker buoy devices designed for marking a nautical location. Typical of these is U.S. Pat. No. 222,215 issued to Wardwell on Dec. 2, 1879.

Another patent was issued to Timmans on Nov. 5, 1895 as U.S. Pat. No. 549,281. Yet another U.S. Pat. No. 832,881 was issued to Skinner et al. on Oct. 9, 1906 and still yet another was issued on May 4, 1915 to Nixon as U.S. Pat. No. 1,137,782.

Another patent was issued to Johnson et al on Nov. 28, 1916 as U.S. Pat. No. 1,206,713. Another patent was issued to Saulnier et al. on Oct. 18, 1988 as U.S. Pat. No. 4,778,422. Another patent was issued to Noggle on Feb. 11, 1992 as U.S. Pat. No. 5,087,216. Another patent was issued to Keller on Feb. 23, 1993 as U.S. Pat. No. 5,188,551. Another patent was issued to Balstad on Oct. 26, 1993 as U.S. Pat. No. 5,256,093. Another patent was issued to Forrest on Dec. 27, 1994 as U.S. Pat. No. 5,376,035. Another patent was issued to Kellner et al. on Sept. 7, 1999 as U.S. Pat. No. 5,947,780. Another patent was issued to Mercer on Sep. 26, 2000 as U.S. Pat. No. 6,123,593.

U.S. Pat. No. 222,215

Inventor: T. G. Wardwell

Issued: Dec. 2, 1879

A sunken vessel indicator having its case provided with the tubular standard and its float provided with the line, and perforated or furnished with the tube to receive the said standard.

U.S. Pat. No. 549,281

Inventor: L. H. Timmans

Issued: Nov. 5, 1895

A buoy for indicating marine wrecks having a sealed chamber provided with an intoning device, and a line for securing the buoy to the wreck in combination with a telescope casing surrounding the line.

U.S. Pat. No. 832,881

Inventor: J. H. Skinner

Issued: Oct. 9, 1906

A buoy comprising a body divided along its longitudinal axis into separable sections, a reel detachably mounted in recesses in the meeting faces of the sections and having an axle the opposite ends of which project beyond the ends of the reel into bearing-sockets in said meeting faces, and a cable wound on said reel and passing through an opening in one of the said meeting faces, the buoy sections being connected by a hinge the axis of which is disposed lengthwise of the sections, substantially as described.

U.S. Pat. No. 1,137,782

Inventor: B. F. Nixon

Issued: May 4, 1915

A device comprising a body converging toward its lower end, a cap fixed upon the upper portion of the body, a ballast member positioned within the lower portion of the body whereby the body will be held in its correct vertical position, signaling means carried above the cap, whereby the signaling means will be held above the water, and means yieldably connecting a cable to the lower portion of the body, the cable adapted to be connected to a vessel whereby when a vessel sinks the body may float and allow the cable to engage a vessel whereby the location of the vessel may be determined, and the yieldable means adapted to prevent the breaking of the cable.

U.S. Pat. No. 1,206,713

Inventor: C. G. Johnson

Issued: Nov. 28, 1916

A signal for locating a vessel after it is sunk including a buoy adapted to float upon the water, the buoy being provided with a substantially V-shaped base, a cradle mounted upon the vessel and provided with a substantially V-shaped seat upon which the V-shaped base of the buoy is adapted to removably rest under normal conditions, the V-shaped seat being provided on opposite sides thereof with upstanding flanges to prevent the buoy from jarring or slipping out of the cradle, and means for anchoring the buoy to the sunken vessel to prevent the buoy from drifting.

U.S. Pat. No. 4,778,422

Inventor: Kenneth D. Saulnier

Issued: Oct. 18, 1988

A buoy for storing rope connected to an underwater article such as a lobster pot, comprises a buoyant casing having two side portions connected together and a reel rotatably mounted between the side portions and carrying a length of rope, one or both outer ends of which are connectable to the lobster pot or the like article. A central portion of one end of the reel is accessible from a side of the buoy through the adjacent casing side portion, and this one end has a non-circular configuration adapted to be engaged by a winding device such as a so-called "pot-hauler". The side portions may be connected together by posts. An end of rope may be connected to the reel by a swivel link so that when the rope is fully paid out the buoy can remain on the surface of the water and can rotate relative to the rope. The buoy is preferably made with two identical side portions of plastics material, and may have rigid molded buoyant foam material held between the side portions.

U.S. Pat. No. 5,087,216

Inventor: Edward F. Noggle

Issued: Feb. 11, 1992

A marker buoy adapted to be held in the hand and thrown on the surface of a body of water to mark a location beneath the surface, comprises a thin, hollow, water-tight box with a concentric aperture through the thickness dimension of the box. The box is constructed of upper and lower concave shells which are mirror symmetric through the medial transverse plane of the box, where the two shells are bonded to one another. Recesses formed between internal walls within the shells hold a reel assembly have a take-up spool located in the aperture, and a crankshaft fitted with a handle protruding through a side of the box. A flexible cord is attached to the take-up spool and wound around the spool by turning the crankshaft handle. The other end of the cord is attached to an anchor weight.

U.S. Pat. No. 5,188,551

Inventor: Cyril N. Keller

Issued: Feb. 23, 1993

A marker device for fishermen including a body or flotation portion made from a transparent, plastic bottle. A sheet of brightly colored fluorescent or retroreflective paper lines the inside of the bottle, making the marker highly visible. A threaded cap is secured to the core or bottom end of a spool, about which an anchor line is wound. The spool has upper and lower flanges, and the anchor line is secured to the upper flange. An anchor weight is secured to the free end of the anchor line, the anchor weight being a strip of malleable lead that may be formed to bend around the anchor line wound on the spool when not in use. Further, a counterweight is contained within the bottom portion of the spool opposite the bottle, causing the marker to stand upright in the water. After the marker has been set in the water and the anchor weight has sunk to the bottom of the lake or stream, the anchor line may be threaded through a slot in the lower flange of the spool, preventing additional anchor line from being paid out from the spool.

U.S. Pat. No. 5,256,093

Inventor: LeRoy Balstad

Issued: Oct. 26, 1993

A lightweight plastic buoy with an elastic shock cord attached to the nylon line and lead weight. Included in the buoy is a plastic spool attached to a metal shaft and crank in a housing. A plastic pin is attached to a foam float. They are found in a housing near the bottom of the buoy and are moved via the admittance of water into the float chamber through an orifice in the bottom cap. The pin forces a lock into notches in the spool which inhibits its motion. A rubber-strap governor is in contact with the top of the spool controlling its velocity to eliminate the tangling of excessive line released from the spool.

U.S. Pat. No. 5,376,035

Inventor: John W. Forrest

Issued: Dec. 27, 1994

The invention discloses a highly visible marker buoy of the self-setting type the anchor line of which may be power wound to facilitate retrieval of the buoy after use; the marker buoy is equipped with spin indicators to prove that the anchor line is descending to the bottom of a body of water; fluorescent and phosphorescent materials are provided to increase both daytime and nighttime visibility.

U.S. Pat. No. 5,947,780

Inventor: Ronald E. Kellner

Issued: Sep. 7, 1999

A marker for use by boaters to mark spots in a body of water includes a watertight, hollow cylindrical main body that floats and which serves as a buoy member. The main body is capped at its opposite ends by end caps that are apertured. An elongate hollow tube is positioned within the hollow interior of the cylindrical main body so that it extends between the apertures. A spool member having a preselected length of line coiled thereabout is rotatably mounted atop the upper end cap and line extends from the spool through the interior of the hollow tube to the bottom of the body of water when the marker is in use, there being a weight at the free end of the line. Beads of progressively larger size relative to the free end of the line are secured to the line, each bead being positioned at a preselected length of the line that represents a particular water depth. A slide plate is slidably mounted to the bottom end cap in alignment with the hollow interior of the tube and bores of differing sizes are formed in the slide plate, each size corresponding to a bead and being slightly smaller than its corresponding bead to prevent its passage through the slide plate. The user aligns a preselected bore, representing a known water depth, with the hollow interior of the tube and unreels the line until a bead is stopped from passing through its associated bore.

U.S. Pat. No. 6,123,593

Inventor: Terry D. Mercer

Issued: Sep. 26, 2000

A highly visible container protected polyurethane foam flotation buoy, with a transparent polycarbonate housing enclosing a plastic line spool which is supported by a stainless steel axle which has a stainless steel rewind handle, with nylon roller, and a adjustable nylon brake assembly. Housing is secured to bottom of flotation buoy, housing assembly and spool assembly which are used in the deployment and take up of anchor and anchor line comprises complete flotation unit. Anchor is a five pound steel core enclosed in PVC with a stainless steel connection bolt. In use anchor will have descended to bottom and buoy will be on top surface of water connected by anchor line and will not drift off marked spot.

While these marker buoys may be suitable for the purposes for which they were designed, they would not be as suitable for the purposes of the present invention, as hereinafter described. It is thus desirable to provide a multipurpose flotation buoy device.

SUMMARY OF THE PRESENT INVENTION

A primary object of the present invention is to provide a marker buoy constructed of material highly resistant to rust and corrosion, thereby giving the marker buoy a long life in a harsh marine environment.

Another object of the present invention is to provide a marker buoy having a reel assembly with a coil spring, line spool and crank handle.

Yet another object of the present invention is to provide a marker buoy consisting of a coil spring to maintain line tension providing a more accurate marking of the area by regulating the extension and retraction of excess line.

Still yet another object of the present invention is to provide a marker buoy having a clear dome compartment for inserting a glow stick therein.

Yet another object of the present invention is to provide a marker buoy that is easy to operate and use, constructed of material highly resistant to rust and corrosion.

Additional objects of the present invention will appear as the description proceeds.

The present invention overcomes the shortcomings of the prior art by providing a marker buoy having means for indicating or locating wrecked or sunken vessels, designating channels, and for various other purposes for which location of a nautical position is required.

The marker buoy of the present invention consists of a polyurethane foam housing enclosing a line spool, supported by a stainless steel axle, having a stainless steel rewind handle and a stainless steel coil spring.

The top portion of the housing consists of a transparent dome housing a glow stick tube for easy location of the device at night. The glow stick tube also assists in locating the device at night or in a fog condition. A glow stick is inserted into the tube and the cap replaced. When the glow stick is spent, a replacement stick may easily replace it.

Furthermore, the glow stick tube may be replaced by a light with an internal power source.

The coil spring functions by exerting a pull on the line when the sinker is dropped. The pull exerted on the line between the buoy and sinker is enough to produce sufficient line tension to keep the marker buoy in the appropriate proximity. The coil spring also allows the release and retraction of line to compensate the rise and fall of tides, or any other disturbance while maintaining line tension between the buoy and sinker weight.

The marker buoy of the present invention is constructed of material highly resistant to rust and corrosion, thereby giving the marker buoy a long life span in a harsh marine environment.

A marker buoy is provided for winding and rewinding a flexible line attachable to an underwater object such as an anchor, comprising: a buoyant housing, the housing having a bottom, the housing bottom having an opening; a reel assembly within the housing having: a shaft having a first end and a second end, the shaft first end protruding through the housing; a handle attached to the shaft first end for rotating the shaft; a spool joined to the shaft second end for rotation as the shaft rotates, the spool being adapted for winding and unwinding the flexible line thereon, the line entering the housing through the housing bottom opening; and a coil spring having a first end and a second end, the coil spring first end being fixedly attached to the housing, the coil spring second end being attached to the spool such that the coil spring is wound when the line is being unwound, and released when the line is being wound back on to the spool.

In another embodiment, the device further comprises a light assembly, the light assembly having a water-tight interior and a light source positioned within the water-tight interior, the light assembly being attached to the housing, the light assembly further being at least partially transparent.

In another embodiment, the housing also has a top, the top having an opening, the light assembly further comprises a separation member received by the housing top and an at least partially transparent covering member, the covering member being attached over the separation member and to the housing top such that the separation member seals the housing top opening, and the light source is attached to the separation member.

In another embodiment, the covering member is dome-shaped.

In another embodiment, the light source further comprises a light-emitting member.

In another embodiment, the light-emitting member is stick-shaped.

In another embodiment, the light source further comprises a battery-powered lamp assembly.

In another embodiment, the light source further comprises a light stick tube, the light stick tube containing a light stick.

In another embodiment, the light stick tube is watertight.

In another embodiment, the coil spring force, when the coil spring is wound, is less than the opposing vertical buoyant force of the water on the device.

In another embodiment, the housing further comprises a flotation ring.

In another embodiment, a marker buoy is provided for winding and rewinding a flexible line attachable to an underwater object such as an anchor, comprising: a buoyant housing, the housing having a bottom, the housing bottom having an opening; a reel assembly within the housing having: a shaft having a first end and a second end, the shaft first end protruding through the housing; a handle attached to the shaft first end for rotating the shaft; a spool joined to the shaft second end for rotation as the shaft rotates, the spool being adapted for winding and unwinding a flexible line thereon, the line entering the housing through the housing bottom opening; a first gear and a second gear, the second gear being larger than the first, the first gear being positioned on the spool such that the first gear rotates as the shaft is rotated, the second gear being positioned for rotation by the first gear; and a coil spring having a first end and a second end, the coil spring first end being fixedly attached to the housing, the coil spring second end being attached to the second gear such that the coil spring is wound when the line is being unwound, and released when the line is being wound back on to the spool.

In another embodiment the device farther comprises a light assembly, the light assembly having a water-tight interior and a light source positioned within the water-tight interior, the light assembly being attached to the housing, the light assembly further being at least partially transparent.

In another embodiment, the housing also has a top, the top having an opening, the light assembly further comprises a separation member received by the housing top and an at least partially transparent covering member, the covering member being attached over the separation member and to the housing top such that the separation member seals the housing top opening, and the light source is attached to the separation member.

In another embodiment, the covering member is dome-shaped.

In another embodiment, the light source further comprises a light-emitting member.

In another embodiment, the light-emitting member is stick-shaped.

In another embodiment, herein the light source further comprises a battery-powered lamp assembly.

In another embodiment, the light source further comprises a light stick tube, the light stick tube containing a light stick.

In another embodiment, the light stick tube is watertight.

In another embodiment, the coil spring force, when the coil spring is wound, is less than the opposing vertical buoyant force of the water on the device.

In another embodiment, the housing further comprises a flotation ring.

In another embodiment, a marker buoy is provided, comprising: a buoyant housing, the housing having a bottom, the housing bottom having an opening; a flexible line; a weighted member attached to the flexible line; a reel assembly within the housing having: a shaft having a first end and a second end, the shaft first end protruding through the housing; a handle attached to the shaft first end for rotating the shaft; a spool joined to the shaft second end for rotation as the shaft rotates, the spool being adapted for winding and unwinding the flexible line thereon, the line entering the housing through the housing bottom opening; a first gear and a second gear, the second gear being larger than the first, the first gear being positioned on the spool such that the first gear rotates as the shaft is rotated, the second gear being positioned for rotation by the first gear; and a coil spring having a first end and a second end, the coil spring first end being attached to the housing, the coil spring second end being fixedly attached to the spool such that the coil spring is wound when the line is being unwound, and released when the line is being wound back on to the spool.

In another embodiment, the device further comprises a light assembly, the light assembly having a water-tight interior and a light source positioned within the water-tight interior, the light assembly being attached to the housing, the light assembly further being at least partially transparent.

In another embodiment, the coil spring force, when the coil spring is wound, is less than the opposing vertical buoyant force of the water on the device.

In another embodiment, the housing further comprises a flotation ring.

A marker buoy is provided, comprising: a buoyant housing, the housing having a bottom, the housing bottom having an opening; and means for winding and unwinding a flexible line, the means being positioned within the housing, the line exiting the housing through the housing bottom opening.

In another embodiment, the device further comprises means for emitting light.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGS.

In order that the invention may be more fully understood, it will now be described, by way of example, with reference to the accompanying drawing in which.

DESCRIPTION OF THE REFERENCED NUMERALS

Figure 1:
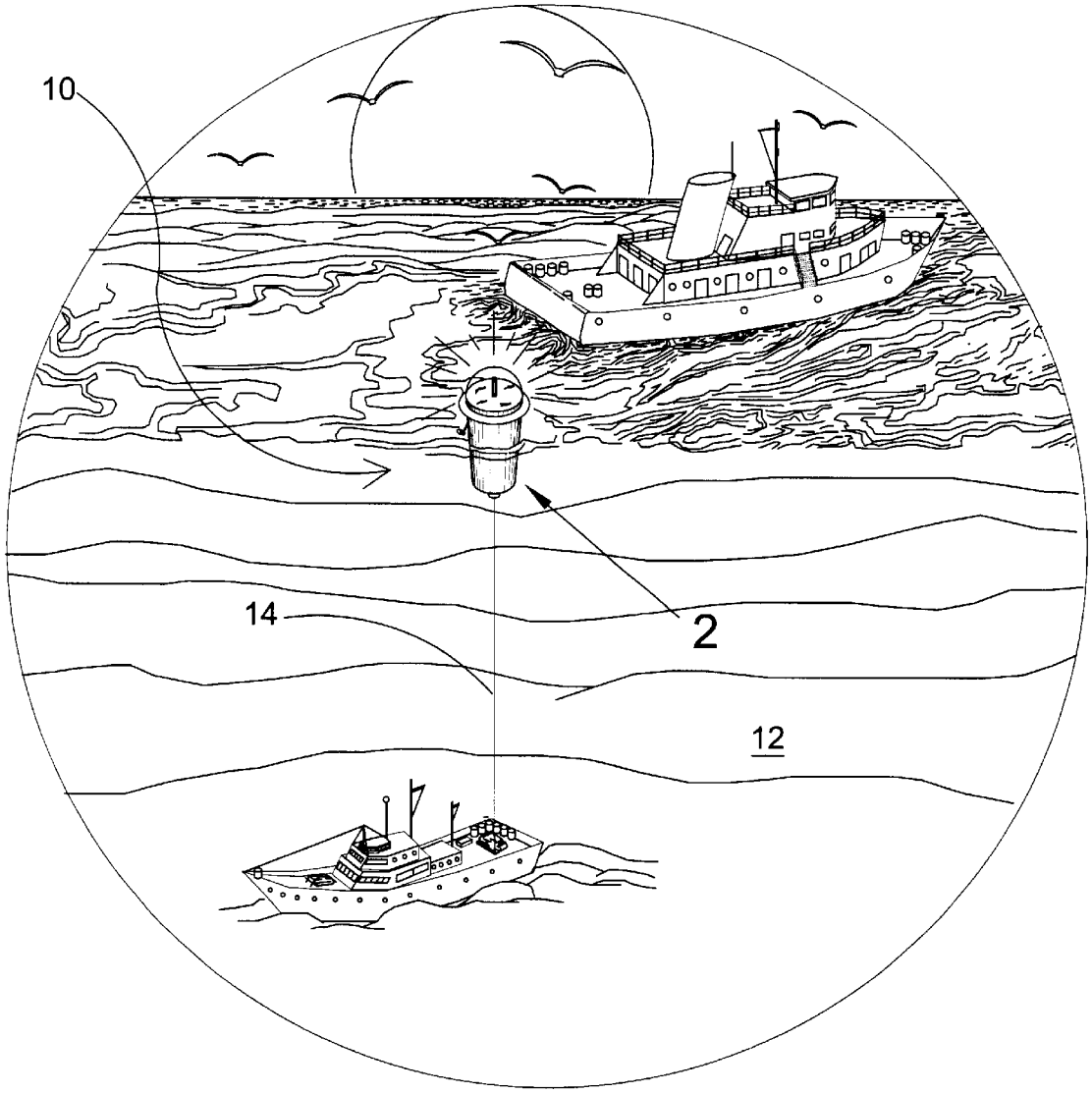
FIG. 1 is a pictorial illustration of the device of the present invention in use.
Figure 2:
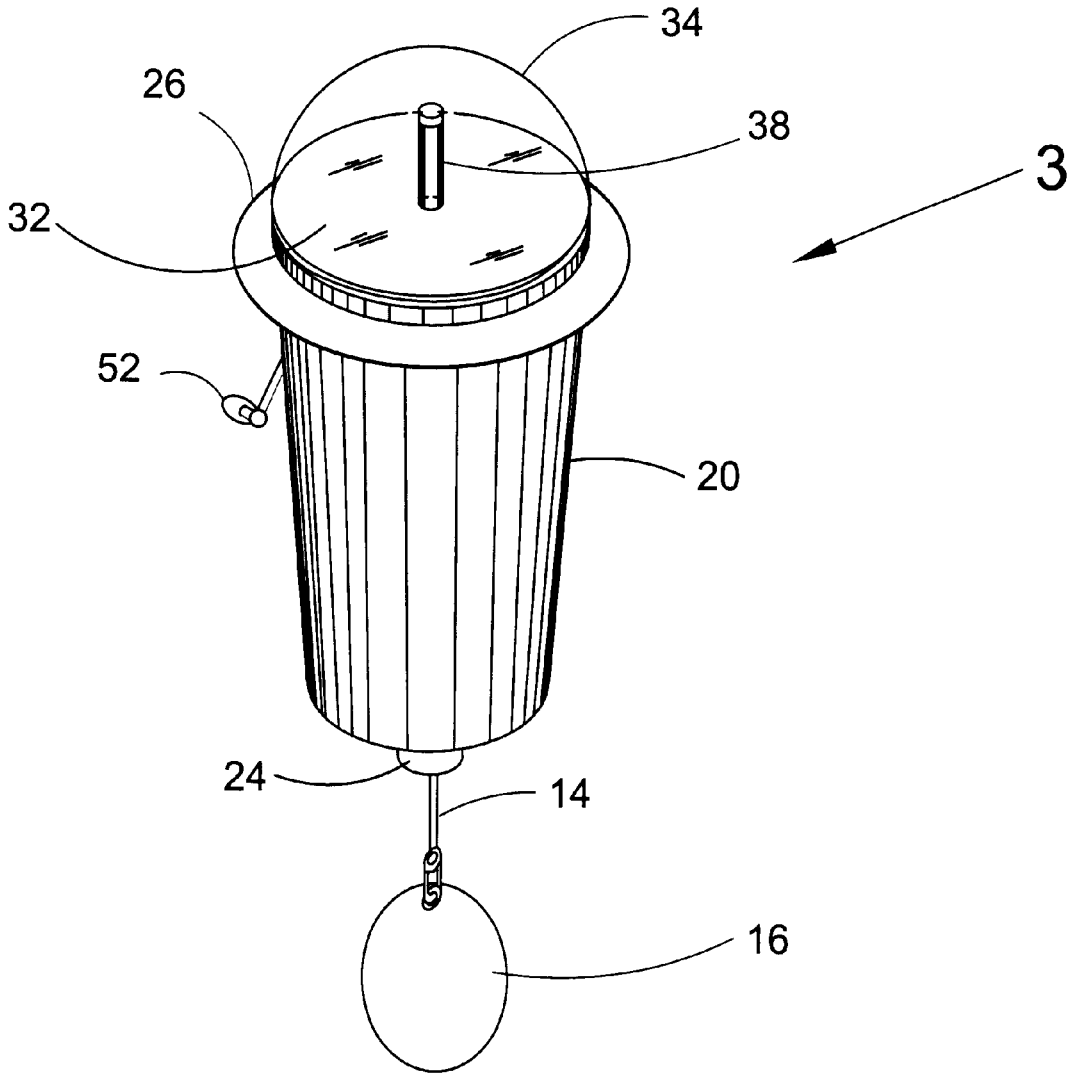
FIG. 2 is a perspective view of the device of the present invention showing the external components that comprise the device.

Turning now descriptively to the drawings, in which similar reference characters denote similar elements throughout the several views, the figures illustrate the Marker Buoy of the present invention. With regard to the reference numerals used, the following numbering is used throughout the various drawing figures.

10 Marker Buoy of the present invention
12 water
14 flexible line
16 anchor
20 housing
22 housing aperture
24 line guide
26 flotation ring
28 flotation ring aperture
30 flotation ring threads
32 buoy access cover
34 transparent dome
36 dome threads
37 glow stick tube
38 glow stick tube cap
39 glow stick
40 reel assembly
42 shaft
44 shaft first end
46 housing aperture
48 shaft second end
50 housing spool post
52 handle
54 spool
56 reduction gear
58 coil spring gear
60 coil spring
62 coil spring first end
64 housing spring post
66 coil spring second end
68 spring attachment member

DETAILED DESCRIPTION OF THE PREFERRED EMBODIMENTS

Turning now descriptively to the drawings, in which similar reference characters denote similar elements throughout the several views, FIGS. 1–90 illustrate the Marker Buoy of the present invention, indicated generally by the numerals 10.

Figure 6:
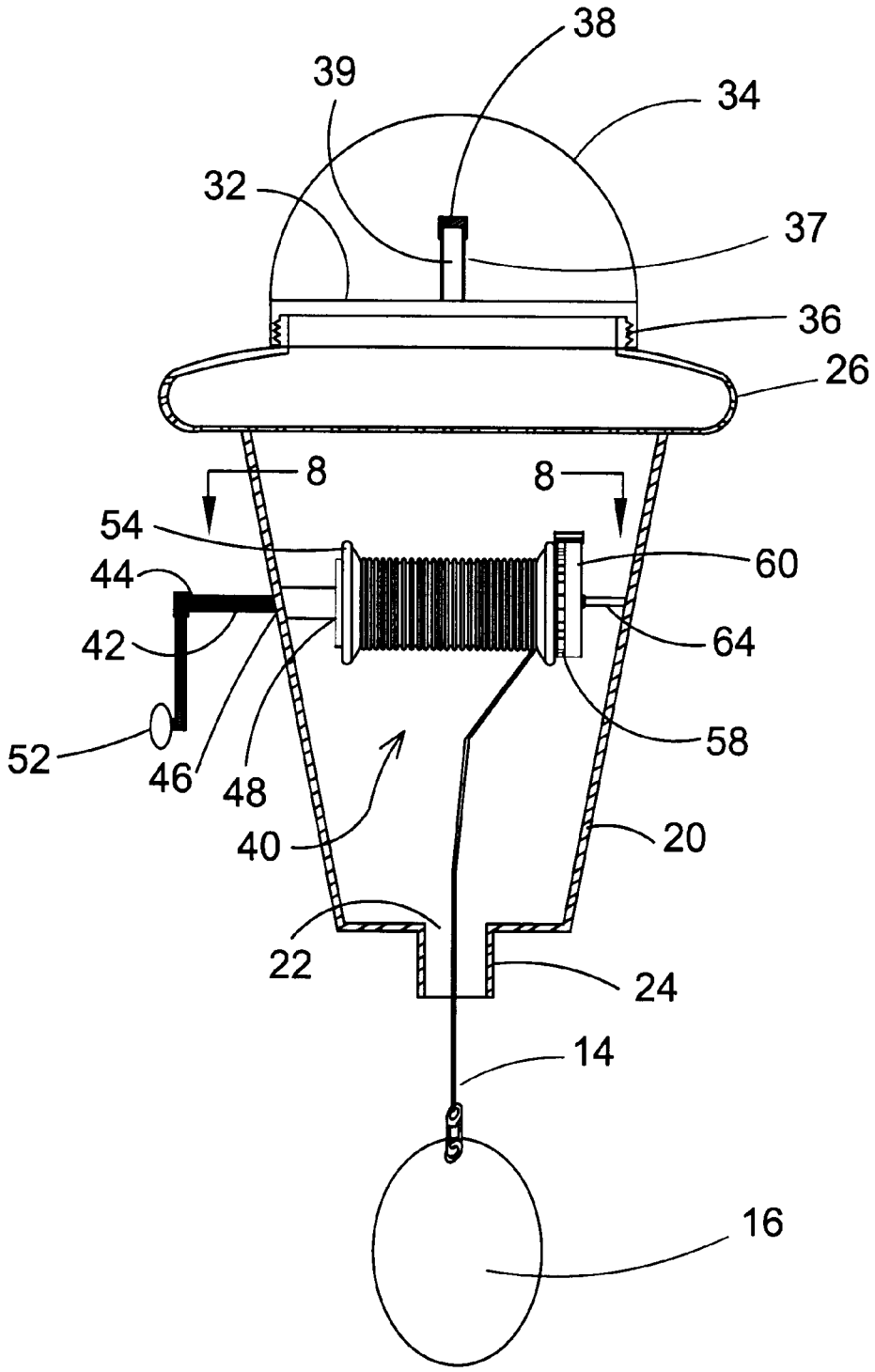
FIG. 6 is a sectional view of the present invention.
Figure 7:
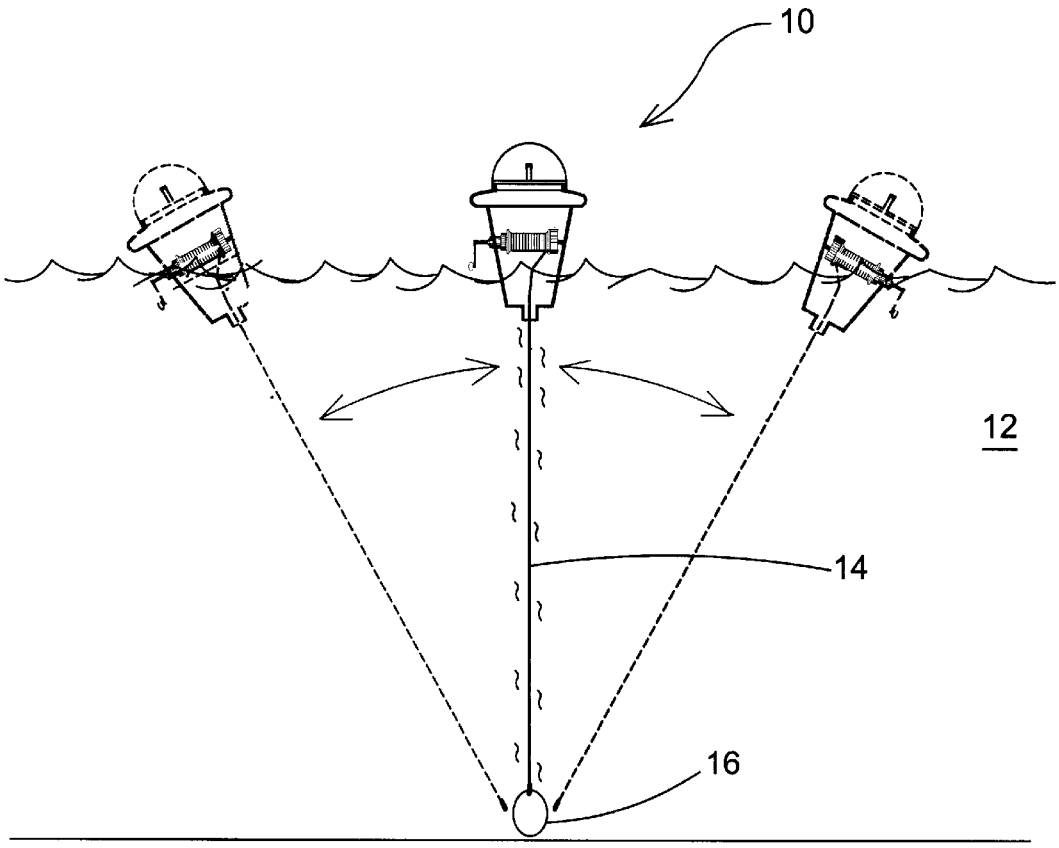
FIG. 7 is a pictorial view of the present invention showing the device floating above water as the sinker portion is at the bottom or floor of the water. The buoy is deviated from its location and then returned via line tension implemented by the coil spring.
Figure 8:
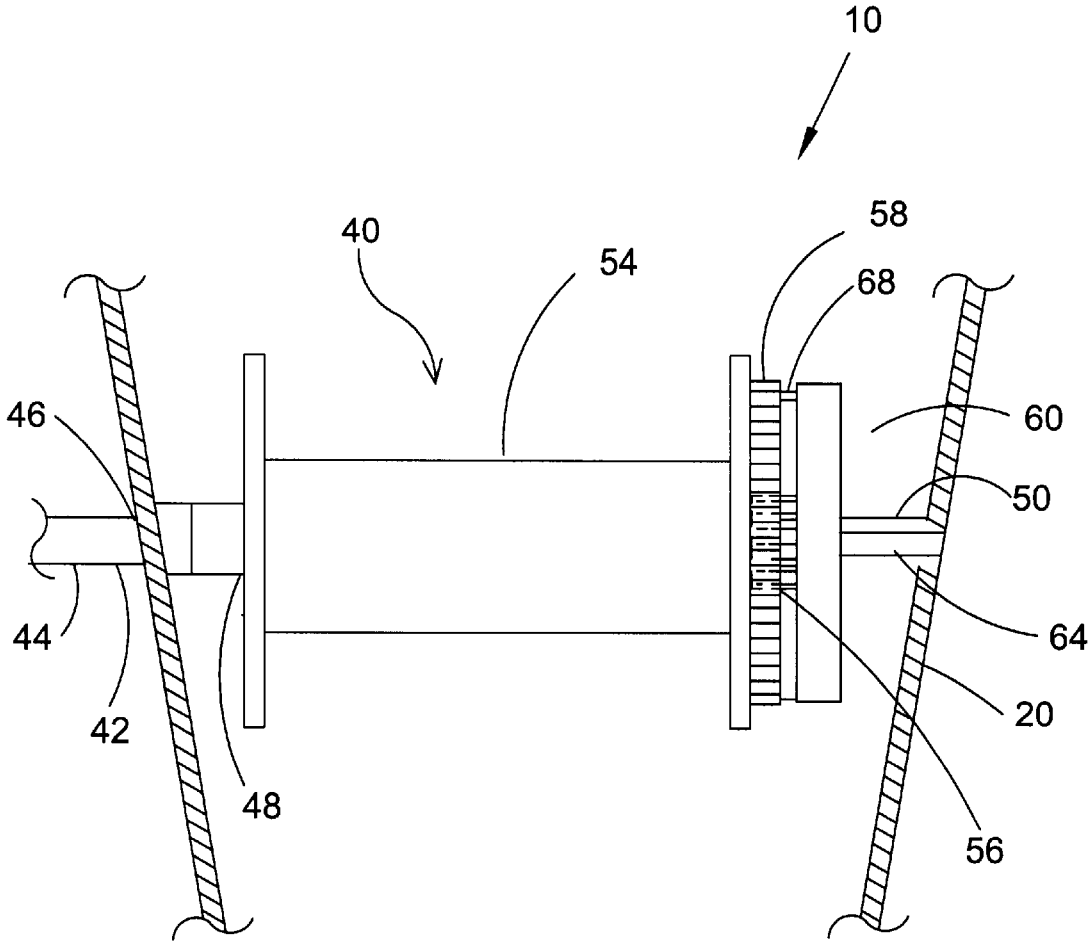
FIG. 8 is a sectional front view of the reel assembly.
Figure 9:
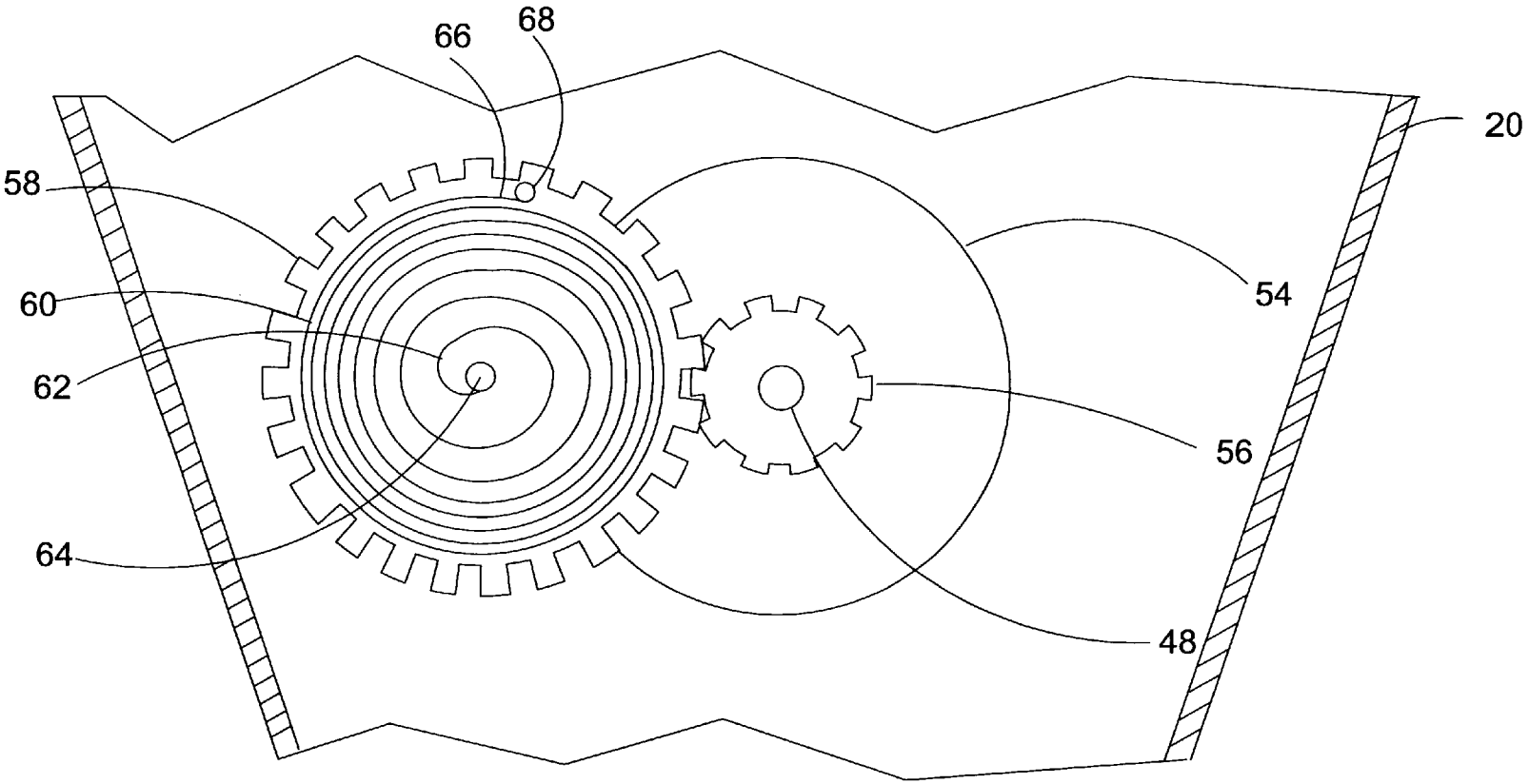
FIG. 9 is a side view of the reel assembly with housing sectionalized for the view.

The Marker Buoy 10 is shown generally in FIGS. 1–9 and in use in the water 12 in FIGS. 1 and 7. In the usage shown, the device 10 is equipped with a flexible line 14 and a sinker 16.

As shown in FIGS. 2–6 and 8–9, the device 10 has a housing 20 that is generally cylindrical, having an opening 22 for the line 14. The line is guided from the housing 20 by a small diameter cylindrical portion 24. The housing 20 is constructed from polyurethane foam. Additional housing structure and buoyancy is provided by a flotation ring 26 integrated with the top of the housing 20. The ring 26 has an aperture 28 that allows hand access into the housing 20.

A threaded upper portion 30 extends from the ring 26, and this upper portion is sized to closely receive a buoy access cover 32. A transparent dome 34 has threads 36 for mating with the threaded upper portion 30 providing a water-tight enclosure bounded by the dome 34 and the top of the buoy access cover 32.

Figure 3:
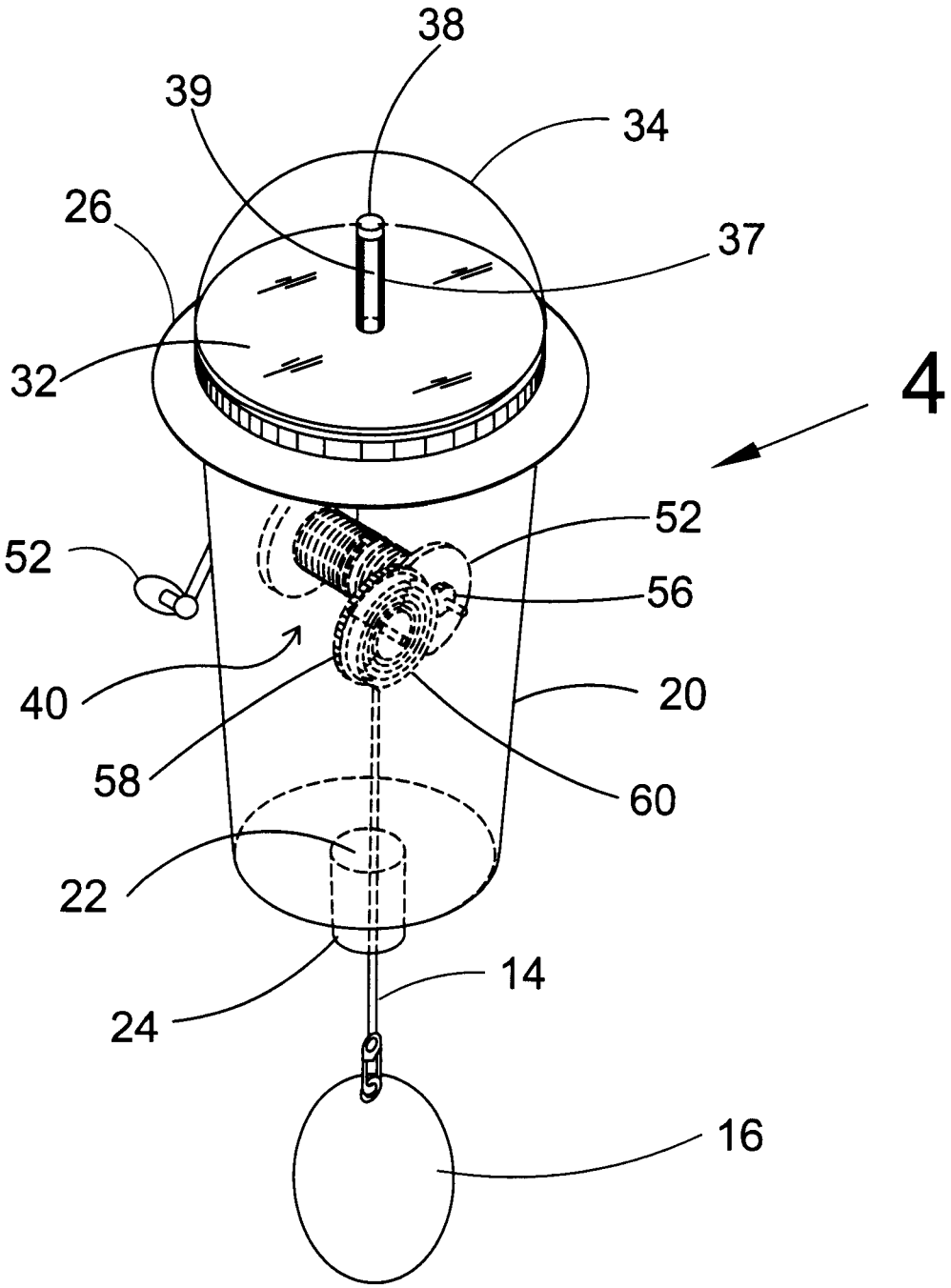
FIG. 3 is a perspective view of the device of the present invention showing the external and internal components that comprise the device.
Figure 4:
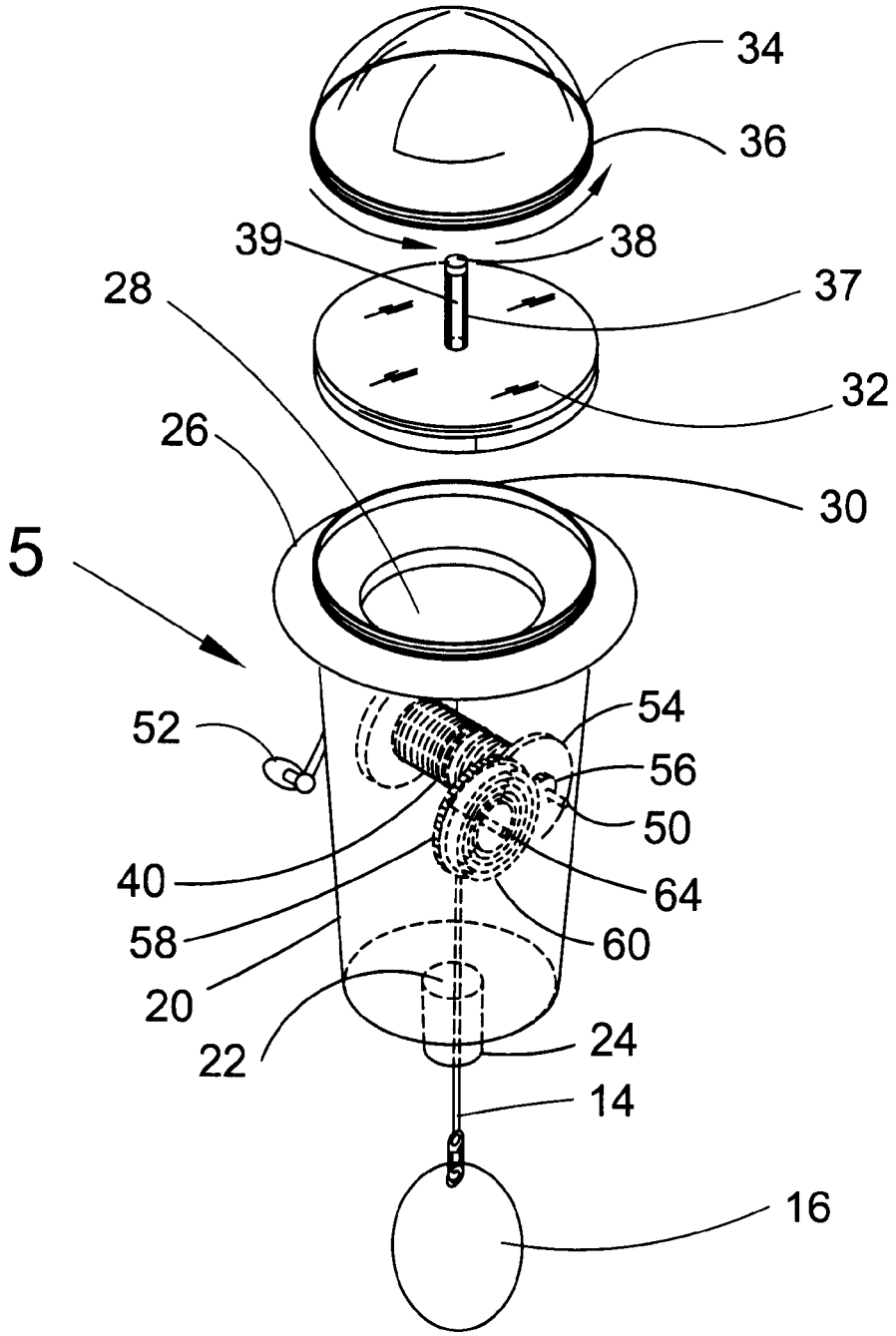
FIG. 4 is an exploded view of the device of the present invention showing the detachable components and internal and external components that comprise the device.
Figure 5:
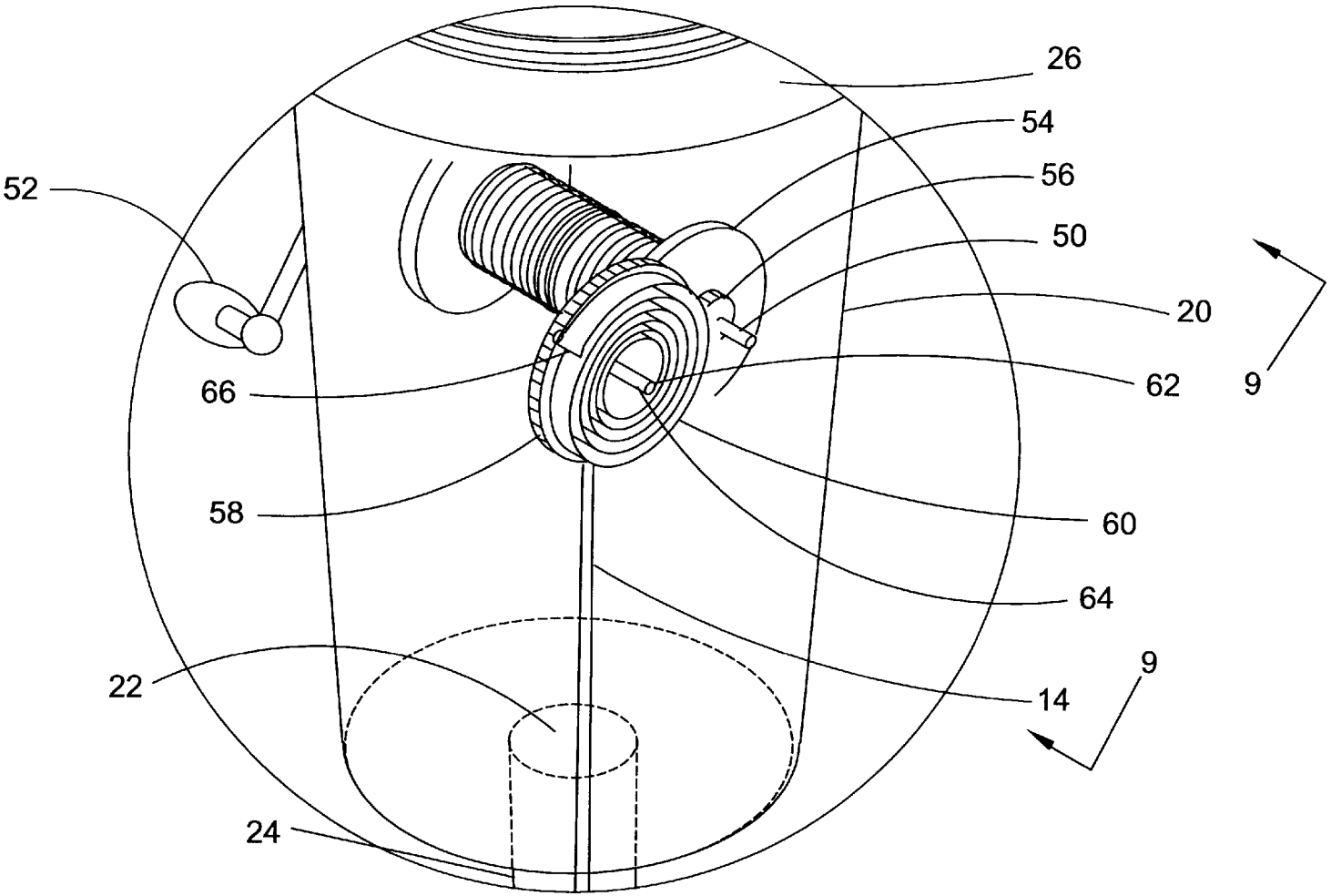
FIG. 5 is a detail view of the reel assembly included in the present invention.

As shown in FIG. 3, a glow stick tube 37 with a cap 38 is centrally disposed upon, and extends upwardly from, the top surface of the buoy access cover 32. A glow stick 39 is insertable within the tube and is chemiluminescent. Due to the glow stick's 39 positioning under the transparent dome 34, the glow stick 39 is highly visible under low light conditions. In other embodiments, a battery or solar powered light source, or other light sources can be substituted, all in accordance with the present invention, as will occur to those of skill in the art upon review of the present disclosure.

A reel assembly 40 is positioned within the housing 20, with a shaft 42 having a first end 44 protruding through an aperture 46 in the side of the housing 20. A handle 52 is attached to the shaft first end 44 for hand rotation of the shaft 42.

As shown in FIG. 6, a spool 54 is joined to the shaft 42 at the shaft second end 48. The spool 54 rotatably joins the housing 20 at a housing spool post 50 for convenient winding and unwinding of the flexible line 14 by hand-rotation of the shaft 42 using the handle 52.

Positioned on the spool 54 is a reduction gear 56. The reduction gear 56 is mated to a larger spring gear 58, such that rotation of the shaft 42 rotates the reduction gear 56, which in turn rotates the spring gear 58. A spiral coil spring 60 has a first end 62 attached to the housing 20 at a housing spring post 64 that extends from the housing 20. The spring 60 has a second end 66 that is joined to the spring gear 58 by an attachment member 68. As the spring gear 58 is rotated the spring second end 64 is rotated such that the coil spring 58 is either wound or unwound, depending on the direction that the handle 52 is turned. The reduction gear 56 causes a significant increase in the number of turns of the spool 54 before the spring 60 is completely wound and further spool 54 rotations are prevented.

The spring 60 is normally unwound when the line 14 is fully wound on the spool 52. Although wound and in tension when the line 14 is unwound from the spool 52, the spring 60 force is not sufficient to cause the device 10 to be pulled under the water 12 surface. The force is sufficient, however, to reduce or eliminate the lateral movement of the device 10 from its normal position directly above the spot marked by the sinker 16, and to return the device 10 to such a position after the current or waves that laterally displaced the device 10 subside. To accommodate a variety of water depths, the user can attach or include additional line 14 beyond the spool 54 and spring 60 effective capacity, and leave as much line 14 as necessary before tying the line 14 to the sinker 16, allowing excess line 14 to trail off from the sinker 16.

In another embodiment, the coil spring is attached directly to the spool for direct rotation, with the coil spring first end attached to the housing spool post.

The device 10 and its foregoing components can be constructed using various materials, including various buoyant materials such as plastic foam, foamed polyethylene, closed cell plastic foam, styrofoam and foam rubber, and can also include fluorescent and phosphorescent materials. The reel assembly 40 components can be made from various corrosion-resistant materials, such as stainless steel and various plastics. All such material combinations and selections are in accordance with the present invention, as will occur to those of skill in the art upon review of the present disclosure.

It will be understood that each of the elements described above, or two or more together may also find a useful application in other applications differing from that described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A marker buoy for winding and rewinding a flexible line attachable to an underwater object such as an anchor, comprising:

a buoyant housing, the housing having a flotation ring and a bottom, the housing bottom having an opening;

a reel assembly within the housing having:

a shaft having a first end and a second end, the shaft first end protruding through the housing;

a handle attached to the shaft first end for rotating the shaft;

a spool joined to the shaft second end for rotation as the shaft rotates, the spool being adapted for winding and unwinding the flexible line thereon, the line entering the housing through the housing bottom opening; and a coil spring having a first end and a second end, the coil spring first end being fixedly attached to the housing, the coil spring second end being attached to the spool such that the coil spring is wound when the line is being unwound, and released when the line is being wound back on to the spool.

2. The device of claim 1, further comprising a light assembly, the light assembly having a watertight interior and a light source positioned within the watertight interior, the light assembly being attached to the housing, the light assembly farther being at least partially transparent.

3. The device of claim 2, wherein the housing also has a top, the top having an opening, and wherein the light assembly further comprises a separation member received by the housing top and an at least partially transparent covering member, the covering member being attached over the separation member and to the housing top such that the separation member seals the housing top opening, and further wherein the light source is attached to the separation member.

4. The device of claim 3, wherein the covering member is dome-shaped.

5. The device of claim 2, wherein the light source further comprises a light-emitting member.

6. The device of claim 5, wherein the light-emitting member is stick-shaped.

7. The device of claim 2, wherein the light source further comprises a battery-powered lamp assembly.

8. The device of claim 2, wherein the light source further comprises a light stick tube, the light stick tube containing a light stick.

9. The device of claim 8, wherein the light stick tube is watertight.

10. The device of claim 1, wherein the coil spring force, when the coil spring is wound, is less than the opposing vertical buoyant force of the water on the device.

11. A marker buoy for winding and rewinding a flexible line attachable to an underwater object such as an anchor, comprising:

a buoyant housing, the housing having a bottom, the housing bottom having an opening;

a reel assembly within the housing having:

a shaft having a first end and a second end, the shaft first end protruding through the housing;

a handle attached to the shaft first end for rotating the shaft;

a spool joined to the shaft second end for rotation as the shaft rotates, the spool being adapted for winding and unwinding a flexible line thereon, the line entering the housing through the housing bottom opening;

a first gear and a second gear, the second gear being larger than the first, the first gear being positioned on the spool such that the first gear rotates as the shaft is rotated, the second gear being positioned for rotation by the first gear; and a coil spring having a first end and a second end, the coil spring first end being fixedly attached to the housing, the coil spring second end being attached to the second gear such that the coil spring is wound when the line is being unwound, and released when the line is being wound back on to the spool.

12. The device of claim 11, further comprising a light assembly, the light assembly having a watertight interior and a light source positioned within the watertight interior, the light assembly being attached to the housing, the light assembly further being at least partially transparent.

13. The device of claim 12, wherein the housing also has a top, the top having an opening, and wherein the light assembly further comprises a separation member received by the housing top and an at least partially transparent covering member, the covering member being attached over the separation member and to the housing top such that the separation member seals the housing top opening, and further wherein the light source is attached to the separation member.

14. The device of claim 13, wherein the covering member is dome-shaped.

15. The device of claim 12, wherein the light source further comprises a light-emitting member.

16. The device of claim 15, wherein the light-emitting member is stick-shaped.

17. The device of claim 12, wherein the light source further comprises a battery-powered lamp assembly.

18. The device of claim 12, wherein the light source further comprises a light stick tube, the light stick tube containing a light stick.

19. The device of claim 18, wherein the light stick tube is watertight.

20. The device of claim 11, wherein the coil spring force, when the coil spring is wound, is less than the opposing vertical buoyant force of the water on the device.

21. The device of claim 11, wherein the housing further comprises a flotation ring.

22. A marker buoy, comprising:

a buoyant housing, the housing having a bottom, the housing bottom having an opening;

a flexible line;

a weighted member attached to the flexible line;

a reel assembly within the housing having:

a shaft having a first end and a second end, the shaft first end protruding through the housing;

a handle attached to the shaft first end for rotating the shaft; a spool joined to the shaft second end for rotation as the shaft rotates, the spool being adapted for winding and unwinding the flexible line thereon, the line entering the housing through the housing bottom opening;

a first gear and a second gear, the second gear being larger than the first, the first gear being positioned on the spool such that the first gear rotates as the shaft is rotated, the second gear being positioned for rotation by the first gear; and a coil spring having a first end and a second end, the coil spring first end being attached to the housing, the coil spring second end being fixedly attached to the spool such that the coil spring is wound when the line is being unwound, and released when the line is being wound back on to the spool.

23. The device of claim 22, further comprising a light assembly, the light assembly having a watertight interior and a light source positioned within the watertight interior, the light assembly being attached to the housing, the light assembly further being at least partially transparent.

24. The device of claim 22, wherein the coil spring force, when the coil spring is wound, is less than the opposing vertical buoyant force of the water on the device.

25. The device of claim 22, wherein the housing further comprises a flotation ring.

* * * * *